United States Patent [19]

Iwaki

[11] Patent Number: 4,748,956

[45] Date of Patent: Jun. 7, 1988

[54] FUEL CONTROL APPARATUS FOR AN ENGINE

[75] Inventor: Masato Iwaki, Hiroshima, Japan

[73] Assignee: Mazda Motor Corporation, Hiroshima, Japan

[21] Appl. No.: 886,227

[22] Filed: Jul. 16, 1986

[30] Foreign Application Priority Data

Jul. 16, 1985 [JP] Japan ..... 60-155243

[51] Int. Cl.[4] ..... F02M 51/00

[52] U.S. Cl. ..... 123/489; 123/400

[58] Field of Search ..... 123/489, 440, 485, 480

[56] References Cited

U.S. PATENT DOCUMENTS

| | | | |
|---|---|---|---|
| 4,461,261 | 7/1984 | Isomura et al. | 123/489 |
| 4,467,770 | 8/1984 | Arimura et al. | 123/489 |
| 4,497,296 | 2/1985 | Nakajima et al. | 123/489 |
| 4,552,116 | 11/1985 | Kuroiwa et al. | 123/440 |
| 4,561,400 | 12/1985 | Hattori | 123/440 |
| 4,602,601 | 7/1986 | Kanai | 123/485 |
| 4,625,699 | 12/1986 | Kobayoshi et al. | 123/440 |
| 4,627,402 | 12/1986 | Saito et al. | 123/489 |
| 4,644,921 | 2/1987 | Kobayoshi et al. | 123/489 |
| 4,664,086 | 5/1987 | Takeda et al. | 123/489 |

*Primary Examiner*—Raymond A. Nelli

*Attorney, Agent, or Firm*—Wegner & Bretschneider

[57] ABSTRACT

The control of a quantity of supply fuel to allow the air-fuel ratio of a gas mixture to be a target air-fuel ratio is conducted by switching between an open loop control and a feedback control using an air-fuel ratio sensor, in response to an operating state of the engine. At the time of the feedback control, a learning correction is carried out using a learning value calculated on the basis of the feedback correction value. At the time of the open loop control, the quantity of the supply fuel is corrected in accordance with the feedback correction value and the learning value immediately before shifting from the feedback control to the open loop control.

14 Claims, 6 Drawing Sheets

FUEL CONTROL APPARATUS FOR AN ENGINE

BACKGROUND OF THE INVENTION

Field of the Invention

The present invention relates to a fuel control apparatus for an engine and, more particularly, to a fuel control apparatus to allow an air-fuel ratio in a gas mixture to be controlled by switching between an open loop control and a feedback control in response to the operating state of the engine and further to allow a control by learning or a learning control to be conducted at the time of the feedback control.

In an engine, particularly an internal combustion engine for vehicles, an air-fuel ratio is frequently controlled according to an output from an air-fuel ratio sensor such as an $O_2$ sensor, that is, a fuel amount supplied to the engine is frequently controlled (or corrected) so that the air-fuel ratio of a mixture gas become a target value.

This feedback control has a problem in the responsiveness of the control. Thus, control by learning or a learning control, in addition to the feedback control, has been recently proposed. In Japanese Patent Application Laid-Open No. 59335/1983, the feedback correction is conducted using a feedback correction value that is obtained in accordance with an output from an $O_2$ sensor for detecting the oxygen concentration (air-fuel ratio) in exhaust gas. A learning value is calculated according to the feedback correction value and the learning value is stored in memory means having, for example, a plurality of learning zones divided at every predetermined vehicle speed. At a certain vehicle speed while conducting a sort of prospect control by the learning correction in accordance with the learning value stored in the learning zone of the memory means, corresponding to the vehicle speed, the feedback control as described hereinabove is carried out. Accordingly, an amount of correction by the feedback control (feedback correction value) can be reduced by the amount of the prospect control with the learning value, thus leading to a higher responsiveness of the control.

In particular, according as an increase in the number of learnings as the same driving state is continued for a long period of time, the amount of correction by the feedback correction can be extremely reduced. Also such a learning control may absorb the individual difference of engines, in particular, the individual difference of fuel injection valves, which affects the setting of supplying the fuel amount to a great extent or the individual difference of sensors for detecting the amount of intake air.

In general, the feedback control to control the air-fuel ratio of the gas mixture is frequently used only in a particular operating range of an engine. In the operating range where the feedback control is not carried out, an open loop control is used to control the air-fuel ratio.

In order to enhance the accuracy of the air-fuel ratio in the open loop control range or to suppress a variation in the air-fuel ratio due to the individual difference as small as possible, it was proposed to correct the supply fuel amount at the time of the open loop control using the feedback correction value (Japanese Patent Publication No. 40010/1983)

However, when the control is shifted to the open loop control range in the state that the feedback control is applied as in such conventional control, the problems which follow may arise. In the conventional control, the learning value is altered at every learning time and sequentially optimized, while contribution of the feedback correction decreases. Accordingly, even if the control is shifted to the open loop control range while the feedback correction is applied, no particular effects are expected. Further, variations in the air-fuel ratio due to disorders in the feedback range result directly in the influence on the control of the air-fuel ratio in the open loop control range.

SUMMARY OF THE INVENTION

Therefore, it is an object of the present invention to provide a fuel control apparatus for an engine, wherein a quantity of fuel supplied to the engine is controlled in response to the operating state of the engine by switching between a feedback control and an open loop control based on an air-fuel ratio sensor, and a learning correction is also conducted using a learning value calculated according to the feedback correction value at the time of the feedback control, thus enabling the air-fuel ratio at the time of the open loop control to be controlled more accurately.

It is another object of the present invention to provide a fuel control apparatus for an engine wherein the air-fuel ratio control at the time of the feedback control is optimized to further accurately control the air-fuel ratio at the time of the open loop control.

For achieving the above first object, a first aspect of the present invention is fundamentally constituted as claimed in claim 1. With such an arrangement, the correction of the supply fuel amount at the time of the open loop control is optimized according to the feedback correction value and the learning value, thus leading to a more precise control of the air-fuel ratio from immediately after switching to the open loop control.

With this arrangement, even if the control is shifted to the open loop control immediately after the learning value is altered, the air-fuel ratio is furthermore optimized at the time of the open loop control in response to the alteration of the learning value.

The distinction between the open loop control range and the feedback control range can be suitably set in response to the operating state of the engine. In this case, as has been heretofore frequently conducted, it is preferable to distinguish the two ranges using the engine load and the engine speed as parameters.

An air-fuel ratio sensor used in the present invention may include an $O_2$ sensor which operates in ON or OFF at a stoichiometric air-fuel ratio as a boundary if the feedback control is conducted in the stoichiometric air-fuel ratio. If the feedback control is carried out in a wide range of air-fuel ratios, for example, in a stoichiometric air-fuel ratio or in an air-fuel ratio representing a gas mixture leaner than the stoichiometric air-fuel ratio, a so-called lean sensor which may supply a signal substantially proportional to the air-fuel ratio may be used as an air-fuel ratio sensor.

As fuel supply means for supplying fuel to the engine may be used a so-called feedback type carburetor, but it is preferable to use a fuel injection value capable of more accurately regulating a quantity of the supply fuel. In this case, the fuel injection amount from the fuel injection valve may be regulated by controlling a pulse width of its drive pulse (e.g., a duty control).

In instances where memory means for storing the learning values is used in which a plurality of leaning zones are divided in response to the driving states of the engine, parameters for the driving state of the engine may contain the most fundamental engine load and the engine speed or number of engine revolutions.

The above and other objects, features and advantages of the present invention will be apparent from the description of preferred embodiments which will be hereinafter described in detail with reference to the accompanying drawings.

DETAILED DESCRIPTION OF THE PREFERRED EMBODIMENTS

The present invention will now be described in more detail by way of a preferred embodiment with reference to the accompanying drawings.

Figure 1:
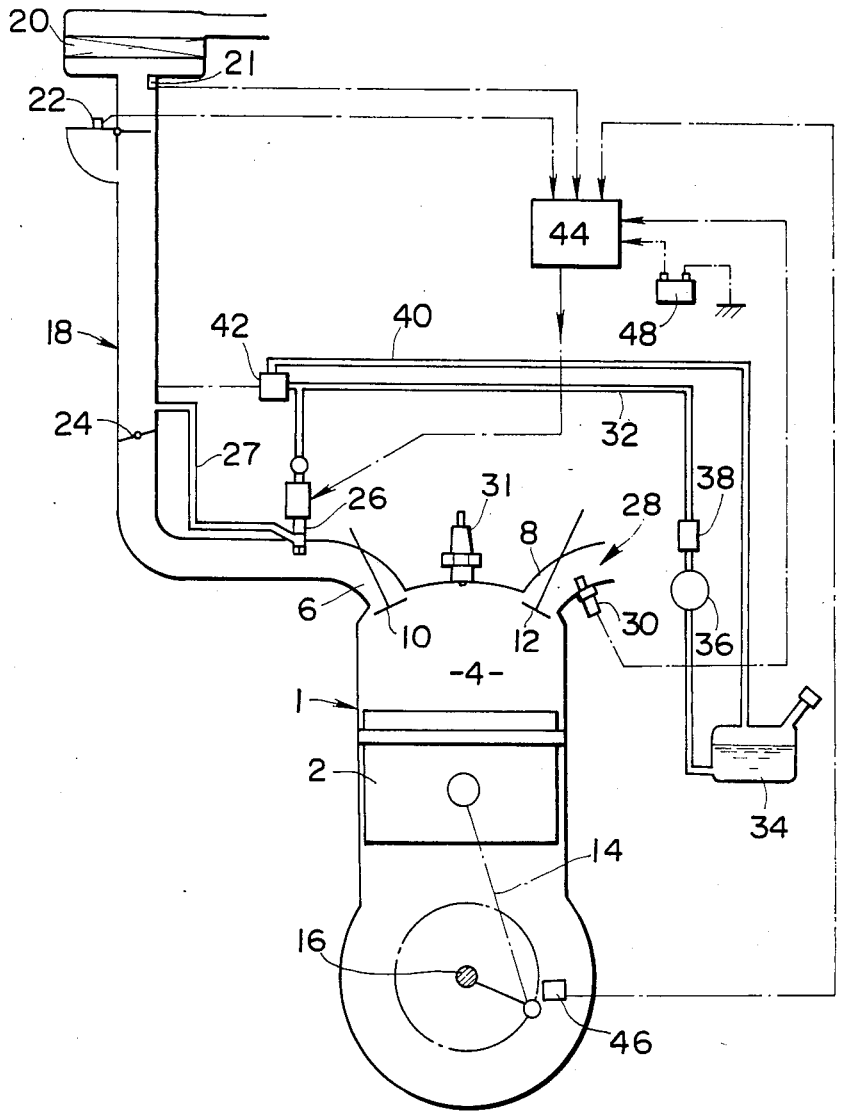
FIG. 1 is an entire system view showing a fuel control apparatus for an engine according to one embodiment of the present invention.
Figure 2:
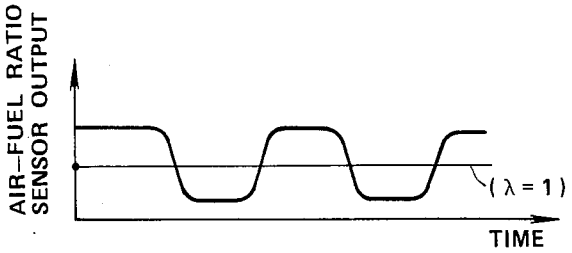
FIG. 2 is a graph showing the state of varying outputs of an air-fuel ratio sensor.

FIG. 1 illustrates one embodiment according to the present invention.

Referring first to FIG. 1, an engine body 1 of 4-cycle reciprocating type is provided with a piston 2 telescoped therein to form a combustion chamber 4. An intake port 6 and an exhaust port 8 are perforated in the combustion chamber 4, an intake valve 10 is disposed in the intake port 6, and an exhaust valve 12 is disposed in the exhaust port 8.

The piston 2 is connected through a connecting rod 14 to an output shaft 16. As the piston 2 reciprocates, the output shaft 16 is rotatably driven, and the intake valve 10 and the exhaust valve 12 are opened and closed at the known timing in synchronization with the rotation of the output shaft 16.

An intake air passage 18 connecting to the intake port 6 is disposed from the upstream side to the downstream sequentially with an air cleaner 20, an intake air temperature sensor 21 for detecting intake gas temperature, an air flowmeter 22 for measuring a quantity of the intake air, a throttle valve 24 for controlling a quantity of the intake air, and a fuel injection valve 26 for supplying fuel into the intake air passage 18. An exhaust gas passage 28 connecting to the exhaust port 8 is disposed with an $O_2$ sensor 30 as well as a catalyzer and a silencer, omitted in the drawing. An ignition plug 31 is also provided.

Intake air purified by the air cleaner 20 is mixed with fuel injected from the fuel injection valve 26, and the resulting gas mixture is filled in the combustion chamber 4. Combustion gas in the combustion chamber 4 is exhausted through the exhaust gas passage 28. The fuel injected from the fuel injection valve 26 is vaporized and atomized with assist air from an assist air passage 27.

The fuel injection valve 26 is connected to a fuel tank 34 through a fuel supply conduit 32 that in turn is arranged with a fuel pump 36 and a fuel filter 38. When the pump 36 is driven, fuel in the fuel tank 34 is fed under pressure to the fuel injection valve 26, and excessive fuel is returned to the fuel tank 34 through a return conduit 40. A fuel pressure regulator 42 is disposed in the return conduit 40, thereby supplying fuel having a predetermined pressure difference from the internal pressure of the intake air passage 18 to the fuel injection valve 26. The quantity of fuel injection from the fuel injection valve 26 is regulated by controlling the valve open time of the fuel injection valve 26 by means of a pulse width of a drive output signal from a control unit 44 (in a duty control).

The control unit 44 is supplied with a feedback signal from the $O_2$ sensor 30, an intake air temperature signal from the intake air temperature sensor 21, an intake air amount signal from the air flowmeter 22, an engine speed signal from an engine speed sensor 46 and a voltage signal from a battery 48. The control unit 44 controls the air-fuel (A/F), that is, the quantity of fuel injection to be injected from the fuel injection valve 26, on the basis of each of the signals supplied.

The control unit 44 is comprised of a digital or analog computer and more particularly a microcomputer. The control unit 44 comprises conventional parts such as a CPU, an ROM, an RAM, a CLOCK and an input/output interfaces. Further, the control unit 44 is also provided with A/D converters in response to the output signals of the respective sensors and drive circuit for the fuel injection valve 26. Since the above-mentioned arrangement utilizing the microcomputer is heretofore known in general, the detailed description will be omitted.

Figure 5:
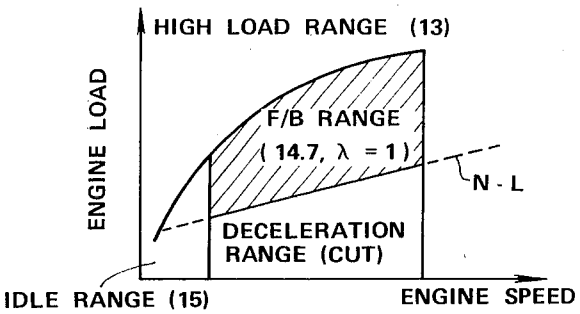
FIG. 5 is a graph showing an example of division of the area for carrying out a feedback control of the air-fuel ratio and the area for carrying out an open loop control in response to the driving state of the engine.

The control by the control unit 44 will be generally described. The operating state of an engine is divided, for example, as shown in FIG. 5, into an idle range, a deceleration range, a feedback range and a high load range in accordance with the engine speed and the load. The control unit 44 controls the air-fuel ratio in response to the respective range of the operating state of the engine. A broken line in FIG. 5 is a no-load line. More specifically, a basic fuel injection amount (a basic fuel injection time $\tau$EI; corresponding to a stoichiometric air-fuel ratio (=14.7) and an oxygen excessive rate $\lambda=1$) is determined in accordance with the intake air amount and the engine speed. A final fuel injection amount (fuel injection time T) is calculated by making various corrections on the basic fuel injection amount, and a drive pulse signal having a pulse width corresponding to this injection amount is supplied to the fuel injection valve 26. The air-fuel ratios in the respective ranges in FIG. 5 are, for example, "14.7" in the feedback range, "15" in the idle range, "13" in the high load range, and the fuel are cut (by half or in full) in the deceleration range. An open loop control (prospect control) is conducted in the ranges other than the feedback range.

Figure 6:
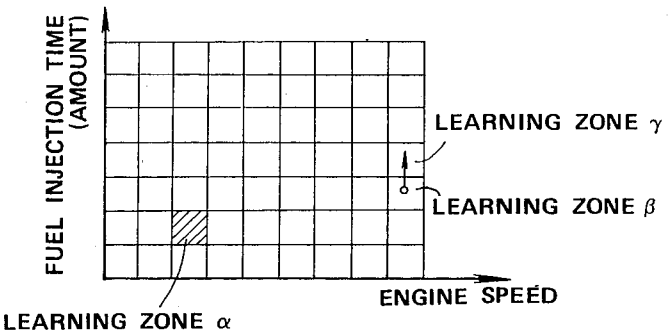
FIG. 6 is a graph showing an example of learning value memory means divided into a plurality of learning zones.

A summary of the control in the feedback range will be described hereinbelow. In the feedback range, a feedback correction according to the feedback signal from the $O_2$ sensor 30 and a learning correction are conducted in the basic fuel injection amount (basic fuel injection time $\tau$EI). In other words, a plurality of learning zones finely divided according to the engine speed and the basic fuel injection time $\tau$EI corresponding to the engine load are set in the feedback range, and the learning values calculated in accordance with the feedback correction value is stored in the respective learning zones of the memory (FIG. 6). The feedback correction value is determined in accordance with a predetermined control gain value (P.I value), and the control gain value (P.I value) and the learning value are altered at every number of learnings.

The fuel injection amount (fuel injection time T) in the feedback range is calculated according to the following equation:

$$T=\tau EI\times C_{AIR}\times(1+C_{FB}+C_{LC})+\tau BAT \quad (1)$$

where $\tau$EI: basic fuel injection time $C_{AIR}$: Intake air temterature correction value $C_{FB}$: Feedback correction value $C_{LC}$: Learning correction value $\tau$BAT: Reactive injection time (Battery voltage correction)

The control gain value (P.I) in the feedback correction value ($C_{FB}$) is altered according to the following equations:

$$C_{FB}=F(P.I)$$

$$P=K\times P_O$$

$$I=K\times I_O$$

where $P_O$: skip width initial value $I_O$: Integrating rate initial value

K: Coefficient

Figure 4:
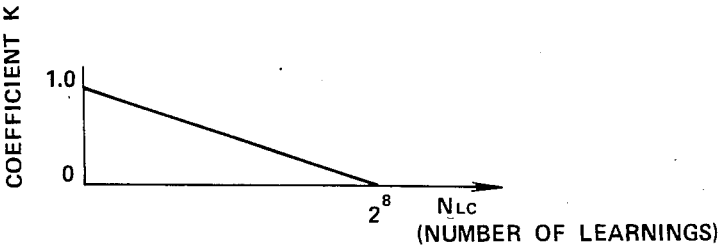
FIG. 4 is a graph showing the relationship between the number of learnings and the feedback correction value in the magnitude of control gain values.

The coefficient K is set smaller, as shown in FIG. 4, as the number of learnings (the number of alterations) $C_{LC}$ increases. From this, the control gain value (P.I value) is set to a small value as the number of learnings $C_{LC}$ advances.

Figure 3:
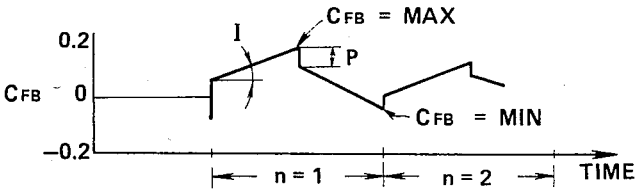
FIG. 3 is a graph showing the state of varying feedback correction values.

The learning value $C_{LC}$ is altered in every number of learnings according to the following equation from the maximum value $C_{FB}$MAX and the minimum value $C_{FB}$MIN of the feedback correction value $C_{FB}$ sampled at every time zone n=1, n=2, . . . (for example, at every zone of 8 msec.) as shown in FIG. 3 at every learning time according to the following equation. In the following equation, "j" means the sequential number of alterations of the learning value, and "i" means the value reduced in the sampling number as the value of "i" is smaller.

$$C_{LCj+1} = C_{LCj} + \tfrac{1}{4}\cdot\sum_{i=1}^{n}(C_{FB}\mathrm{MAX} + C_{FB}\mathrm{MIN})/2^{n-i+1} \quad (2)$$

When the learning value is altered according to the above, the feedback correction value $C_{FB}$ is also altered or initialized on the basis of the following equation:

$$C_{FBj+1} = C_{FBj} - \tfrac{1}{4}\cdot\sum_{i=1}^{n}(C_{FB}\mathrm{MAX} + C_{FB}\mathrm{MIN})/2^{n-i+1} \quad (3)$$

From the above equation, as the number of learnings $C_{LC}$ advances, the learning value $C_{LC}$ is sequentially optimized, and the responsiveness of the feedback control is gradually improved. When the learning value is altered, for example, in the learning zone $\alpha$ of FIG. 6. the deviation $\Delta x$ of the learning value before and after the alteration is calculated from the equation (2).

$$\Delta x = \tfrac{1}{4}\cdot\sum_{i=1}^{n}(C_{FB}\mathrm{MAX} + C_{FB}\mathrm{MIN})/2^{n-i+1}$$

Figure 7:
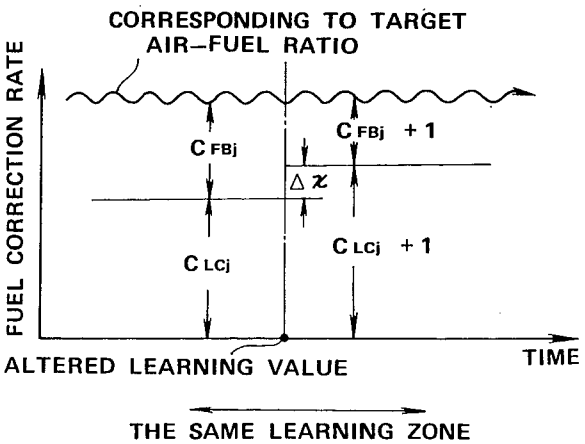
FIG. 7 is a graph showing the relationship between the feedback correction value and the learning value before and after the alteration of the learning values.

The $\Delta x$ is an correction amount of the feedback correction value when the learning value is altered. The relationship between each of the learning values $C_{LCj}$, $C_{LCj+1}$, $C_{FBj}$ and $C_{FBj+1}$ and the $\Delta x$ before and after the learning value is altered as shown in FIG. 7. As readily understood from FIG. 7, the feedback correction value $C_{FBj+1}$ is optimized in response to the alteration of the learning value immediately after the learning value is altered, leading to improvements in the responsiveness of the control, and, as a result, in accuracy in the control of the resultant air-fuel ratio.

When one learning zone is shifted to other learning zone, e.g., when the learning zone $\beta$ is shifted to the learning zone $\tau$ as in FIG. 6, the initial value $C_{FB0}$ of the feedback correction is initialized according to the following equation:

$$C_{FBO}=C_{FBk+1}+(C_{LCk+1}-C_{LCk+2}) \quad (4)$$

where $C_{FBk+1}$: the feedback correction value immediately before the learning zone is shifted $C_{FCk+1}$: the learning value before the shift (e.g., stored value of the learning zone $\beta$)

$C_{LCk+2}$: the learning value after the shift (e.g., stored value of the learning zone $\tau$)

The deviation $\Delta y$ of the learning value before and after the shift of the learning zone is as evident from the above equation (4):

$$y=C_{LCk+1}-C_{LCk+2}$$

Figure 8:
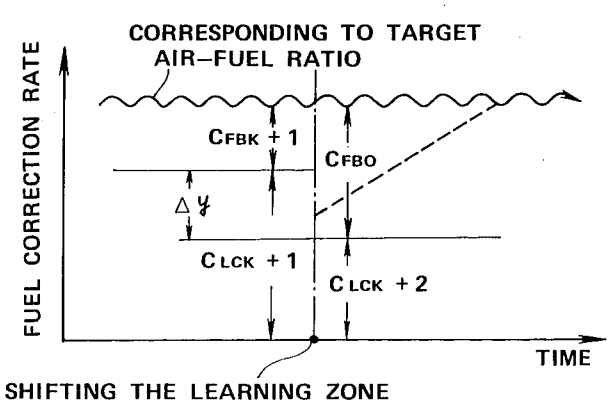
FIG. 8 is a graph showing the relationship between the feedback correction value and the learning value before and after the shift of the learning zones.

The initial value $C_{FB0}$ of the feedback correction value initialized immediately after the learning zone is shifted is a value corrected by the amount $\Delta y$ from the feedback correction value $C_{FBk+1}$ before the shifting (FIG. 8).

Figure 9:
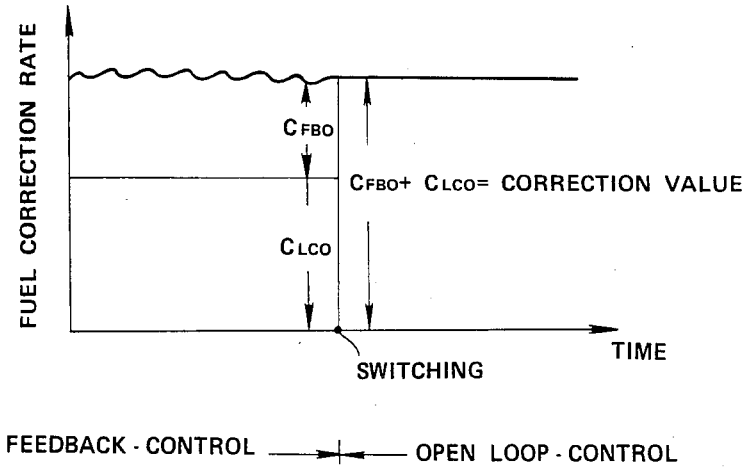
FIG. 9 is a graph showing the relationship between the feedback correction value and the learning value, before and after shifting from the feedback control to the open loop control, and a correction value for the open loop control.

On the other hand, in the open loop control range, the fuel injection time (T) is calculated according to the following equation:

$$T=\tau EI\times C_{AIR}\times(1+C_{ACC}+C_{Zone}+C_{FBO}+C_{LCO})+\tau BAT \quad (6)$$

where $\tau$EI: basic fuel injection time $C_{AIR}$: intake air temterature correction $C_{ACC}$: correction of the time of acceleration $C_{Zone}$: zone correction $\tau$BAT: reactive injection time $C_{FBO}$: feedback correction value immediately before shifting to the open loop control $C_{LCO}$: learning value immediately before shifting to the open loop control More specifically, in the fuel injection control in the open loop control range, the basic fuel injection amount (basic fuel injection time $\tau$EI) is corrected in accordance with a correction value that is an addition of the feedback correction value $C_{FBO}$ to the learning value $C_{LCO}$, immediately before shifting to the open loop control (FIG. 9).

From the above, since the feedback correction value $C_{FBO}$ and the learning value correction $C_{LCO}$ immediately before the shifting are reflected for the correction of the fuel injection amount even after shifted to the open loop control, the variations in the air-fuel ratio due to the individual difference can be suppressed.

Figure 10A:
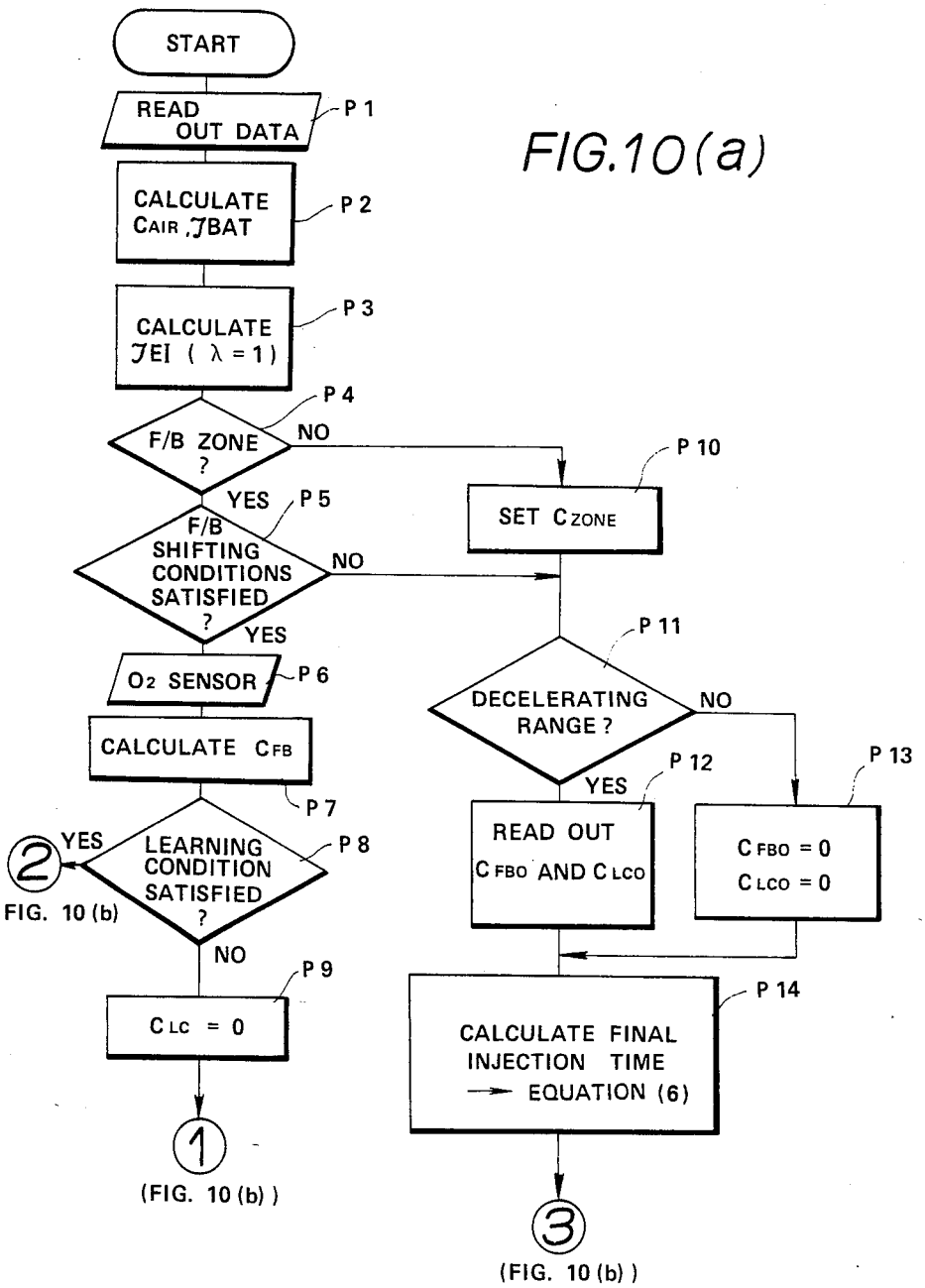
FIGS. 10(*a*) and 10(*b*) are flowcharts showing examples of the control according to the present invention.
Figure 10B:
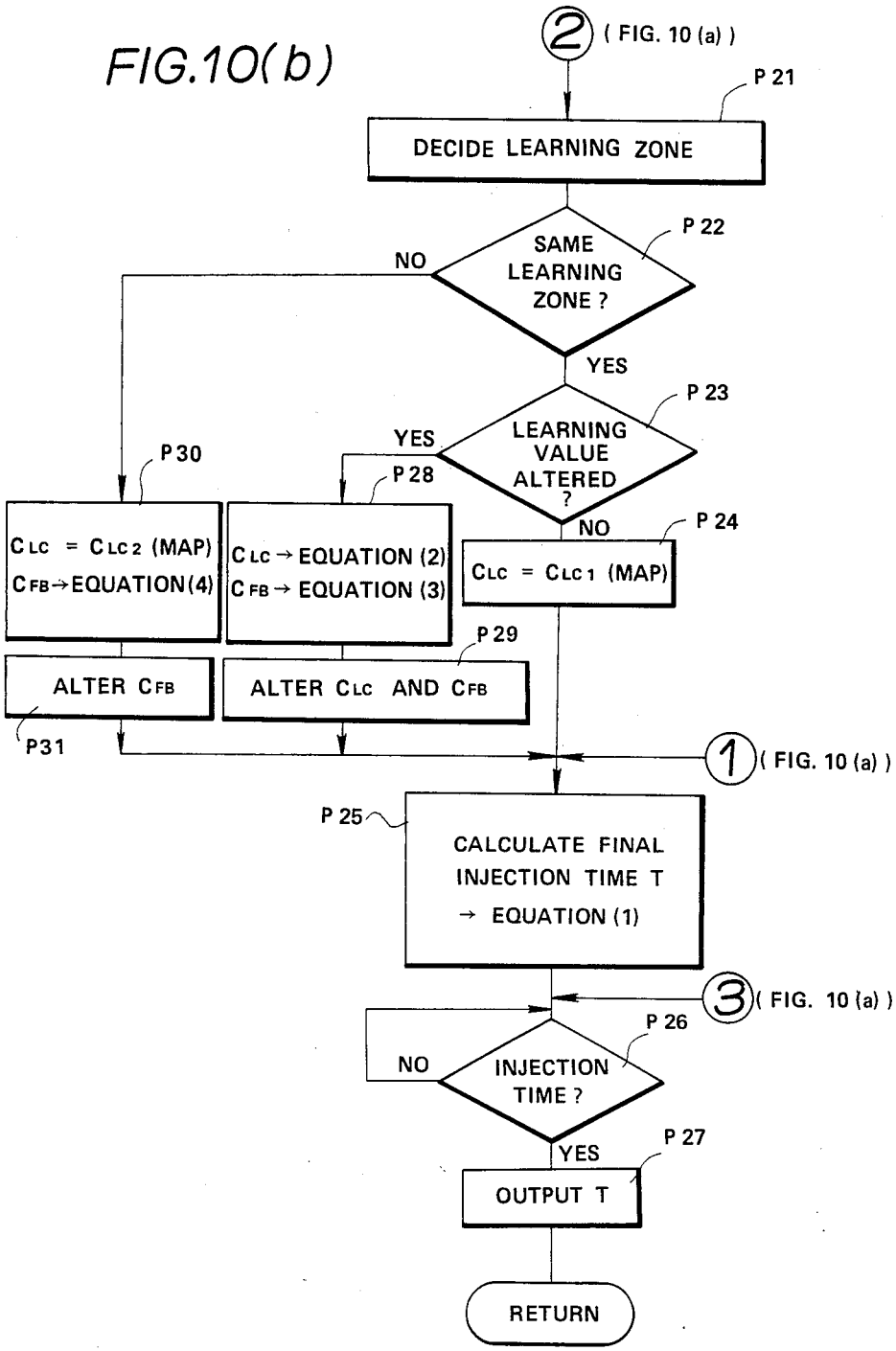

The control by the control unit 44 as described hereinabove will be further described with reference to flowcharts in FIGS. 10(*a*) and 10(*b*). In FIGS. 10(*a*) and 10(*b*), the sampling of the feedback correction value $C_{FB}$ is conducted by means of an interrupt. The countup of the number of learnings $C_{LC}$ is executed in every alteration of the learning value with the prerequisite that the learning value is in the identical learning zone.

Further, the correction according to the feedback correction and the learning value at the time of the open loop control is conducted only in the decelerating range. And the feedback control is executed, for example, when the following conditions (1) to (4) are all satisfied even if the operating state of the engine falls in the feedback range as shown in FIG. 6.

(1) Engine coolant temperature TW > 60° C.

(2) Intake air amount ≧ 10% of cylinder stroke capacity (3) The intake air amount for the engine speed is disposed out of the high load range and the decelerating fuel cut range.

(4) The $O_2$ sensor 30 is active.

In step P1, signals from each of the sensors 21, 22 and 46 except the $O_2$ sensor 30 and the battery voltage are read out. In step P2, the intake air temperature correction coefficient $C_{AIR}$ is calculated in accordance with the intake air temperature, and the voltage correction value (reactive injection time) $\tau$BAT is calculated according to the battery voltage. In step P3, the basic fuel injection amount (time) $\tau$EI is calculated in accordance with the intake air amount and the engine speed. The basic fuel injection amount EI here corresponds to the stoichiometric air-fuel ratio ($\lambda = 1$).

In step P4, it is decided whether the current engine operating state satisfies a feedback condition or not. This decision is fundamentally conducted by referring to the map in FIG. 5. If the feedback conditions are not satisfied in the decision of step P4, the control flow is shifted to step P5. In step P5, it is decided whether the feedback executing conditions described in the above paragraphs (1) to (4) are satisfied or not.

When the feedback conditions are decided to be satisfied in step P5, the control flow is shifted to step P6, and the air-fuel ratio from the $O_2$ sensor 30 is read out. In step P7, the feedback correction value $C_{FB}$ is calculated according to the signal from the $O_2$ sensor 30 as already described above.

After the step P7, it is decided, in step P8, whether the conditions for executing the learning correction is satisfied or not. This decision is made by observing whether a predetermined time, more specifically, 2 seconds, is elapsed or not from the state of the feedback correction when the number of samplings of the feedback correction value $C_{FB}$ that become the bases of calculating the learning value becomes a predetermined value or larger. In step P8, if it is decided that the conditions of the learning correction are not satisfied, the learning correction value $C_{LC}$ is set to "0" in step P9.

After the step P9, the control flow is shifted to step P25 (in FIG. 10(*b*)), the final fuel injection time T is calculated according to the above equation (1). Then, in step P26, after a predetermined fuel injection time is elapsed, the final injection time T calculated in step P25 is output in step P27 to cause a fuel injection.

If the conditions of the learning correction is decided to be satisfied in step P8, the control flow is shifted to step P21, and the current learning zone is decided. Then, in step P22, it is decided whether the current learning zone is the same as the previous learning zone or not. If it is decided, in step P22, that the current learning zone is the same as the previous learning zone, it is decided, in step P23, whether the learning zone is altered or not. This decision is made by observing whether 2 seconds are elapsed or not from the previous learning alteration. In step P23, when it is decided that the learning value is not altered, the learning correction value $C_{LC}$ is set, in step P24, to the learning value $C_{LC1}$ stored in the corresponding learning zone by referring to the map in FIG. 6. Then, the processes after step P25 are conducted.

If it is decided, in step P23, that the learning value is altered, the control flow is shifted to step P28, and the learning value $C_{LC}$ is calculated according to the previous equation (2). And the feedback correction value $C_{FB}$ is calculated according to the previous equation (3). In step P29, the learning value is altered or updated as the value calculated in step P28, and the feedback correction value $C_{FB}$ is altered or initialized. Thereafter, the processes after step P25 are conducted.

If it is decided, in step P22, that the learning zone is not the same as the previous zone, i.e., when the learning zone is shifted, the learning correction value $C_{LC}$ is set, in step P30, according to the learning value $C_{LC2}$ stored in a new learning zone after shifting. In step P30, the feedback correction value $C_{FB}$ is also calculated according to the previous equation (4). Then in step P31, the feedback correction value $C_{FB}$ is altered or initialized to the value calculated in step P30.

If it is decided, in step P4, that the control flow does not become the feedback control, the control flow is shifted to step P10, while the zone correction value $C_{zone}$ is calculated. The $C_{zone}$ is set to become the target air-fuel ratio corresponding to the current range to be controlled by the open loop control, according to the $\tau$EI in step P3.

After step P10, it is decided, in step P11, whether it is currently in the deceleration range or not. If YES in step P11, the control flow is shifted to step P12, where the feedback correction value $C_{FBO}$ and the learning value $C_{LCO}$ immediately before shifted to the open loop control are read out. In step P14, the final fuel injection time T is calculated according to the equation (6). Then, the processes after step P14 are executed.

In step P11, if NO, the feedback correction value and the learning value are both set to "0" in step P13, and the processes after step P14 are conducted.

Even when NO in step P5, the control flow is shifted to step P11 to conduct the open loop control.

In all of the open loop control ranges, the process in step P12 may be executed (without step P13).

While, in the above-described embodiments, a description has been made of the case where the present invention is embodied as described above, it is to be understood that the present invention is not limited to the particular embodiments. Various other changes, modifications and variations may be made within the spirit and scope of the present invention in a range as claimed in claim 1 with reference to the description of the embodiments and the accompanying drawings.

I claim:

1. A fuel control apparatus for an engine for controlling an air-fuel ratio of a gas mixture to become a target air-fuel ratio by regulating a quantity of fuel supplied to the engine comprising:

fuel supply means for supplying fuel to the engine, operating state detecting means for detecting the operating stsate of the engine, an air-fuel ratio sensor for detecting an air-fuel ratio in exhaust gas of the engine, open loop control means for controlling by an open loop control the supply fuel amount from said fuel supply means, feedback correcting means for feedback correcting the supply fuel amount from said fuel supply means by the feedback correction value calculated in accordance with an output from said air-fuel ratio sensor, learning control means for correcting the supply fuel amount by the learning value calculated according to the feedback correction value at the time of the feedback control, control switching means for switching between the open loop control and the feedback control in response to the operating state of the engine, and correcting means for correcting the fuel amount supplied from said fuel supply means at the time of the open loop control in accordance with the feedback correction value and the learning value immediately before switching from the feedback control to the open loop control.

2. A fuel control apparatus according to claim 1, wherein said learning control means comprises:

sampling means for sampling the feedback correction value at every predetermined time, learning value calculating means for calculating the learning value in accordance with a plurality of feedback correction values sampled by said sampling means, and learning value memory means for storing the learning value calculated by said learning value calculating means, thereby conducting the learning correction in accordance with the learning value stored in said learning value memory means.

3. A fuel control apparatus according to claim 2, wherein said learning value memory means comprises a plurality of learning zones divided in response to the operating states of the engine and stores the learning values calculated by said learning value calculating means in a learning zone corresponding to the operating state of the engine.

4. A fuel control apparatus according to claim 3, further comprising:

discriminating means for discriminating whether one learning zone in said learning value memory is shifted to other learning zone or not in response to the operating state of the engine, and at-the-time-of-shifting initializing means for initializing the feedback correction value used for the feedback correction at the time of shifting learning zones as a value that is an addition of the feedback correction value before shifting to a deviation of the respective learning values between the one and other learning zones.

5. A fuel control apparatus according to claim 4, further comprising:

learning value altering means for altering the learning value in accordance with predetermined conditions, and at-the-time-of-altering initializing means for initializing the feedback correction value used for the feedback correction at the time of altering the learning value as a value that is an addition of the feedback correction value before the alteration to a deviation of the learning values before and after the alteration.

6. A fuel control apparatus according to claim 1, further comprising:

learning value altering means for altering the learning value in accordance with predetermined conditions, and at-the-time-of-altering initializing means for initializing the feedback correction value used for said feedback correction at the time of altering the learning value as a value that is an addition of the feedback correction value at the time of alteration to a deviation of the respective learning values before and after the alteration.

7. A fuel control apparatus according to claim 5 or 6, wherein the feedback correction value calculated in response to the output of said air-fuel ratio sensor is reduced with respect to a deviation from the target air-fuel ratio at every alteration of the learning values.

8. A fuel control apparatus according to one of claims 1 to 6, wherein the target air-fuel ratio when the feedback correction is conducted includes at least a stoichiometric air-fuel ratio.

9. A fuel control apparatus according to one of claim 1 to 6, wherein the fuel supply means is a fuel injection valve, and the regulation of the fuel injection amount from said fuel injection valve is conducted by the pulse width of a drive pulse supplied to the fuel injection valve.

10. A fuel control apparatus according to one of claim 1 to 6, wherein the operating states of the engine representing the switching conditions between the open loop control and the feedback control are set using the engine speed and the engine load as parameters.

11. A fuel control apparatus according to claim 10, wherein the operating state of the engine when the open loop control is conducted includes at least a decelerating range.

12. A fuel control apparatus according to claim 11, further comprising:

inhibiting means for inhibiting the correction by said correction means in open loop control ranges other than the decelerating range.

13. A fuel control apparatus according to claim 5, wherein the alteration of the learning value by said learning value altering means is conducted at every predetermined time when the number of sampling the feedback correction values becomes a predetermined value or larger.

14. A fuel control apparatus according to claim 1, further comprising correction means for correcting the fuel amount relative to a value obtained by an addition of the feedback correction value to the learning value.

* * * * *